United States Patent [19]

Lineberry

[11] Patent Number: 4,486,925

[45] Date of Patent: Dec. 11, 1984

[54] FASTENING BUCKLE FOR CHAINS, STRINGS OF BEADS, PEARLS AND LIKE JEWELRY

[76] Inventor: Patricia H. Lineberry, 1890 Edgecliff Dr., Fullerton, Calif. 92631

[21] Appl. No.: 424,015

[22] Filed: Sep. 27, 1982

[51] Int. Cl.[3] ..... A44B 17/00

[52] U.S. Cl. ..... 24/518; 24/616

[58] Field of Search ..... 24/518, 615, 616, 617, 24/651, 605

[56] References Cited

U.S. PATENT DOCUMENTS

| | | | |
|---|---|---|---|
| 1,238,495 | 8/1917 | Christ | 24/616 |
| 2,164,657 | 7/1939 | Levy | 24/616 X |
| 2,586,758 | 2/1952 | Zear | 24/518 |
| 2,775,013 | 12/1956 | Pedrero | 24/518 |
| 3,423,781 | 1/1969 | Henson | 24/651 |
| 3,462,807 | 8/1969 | Marquarot | 24/616 |
| 4,358,876 | 11/1982 | Colognori | 24/616 |

FOREIGN PATENT DOCUMENTS

| | | | |
|---|---|---|---|
| 229609 | 10/1963 | Austria | 24/616 |

*Primary Examiner*—William E. Lyddane
*Assistant Examiner*—Peter A. Aschenbrenner
*Attorney, Agent, or Firm*—Harvey C. Nienow

[57] ABSTRACT

A clasp or buckle is disclosed for several chains, strings of beads, pearls and like jewelry whereby the chains or strings may be arranged and fastened into various ornamental and multi-stranded closed loop configurations at the option of a user of the jewelry. The clasp or buckle includes a substantially hollow main buckle member having two parts hingedly attached to one another. The main buckle member receives and removably mounts a plurality of connecting members in a substantially parallel, substantially regularly spaced configuration. Ends of the connecting members form hooks, loops or eyelets to which respective ends of the chains or strings of beads, pearls and the like can be mounted.

15 Claims, 15 Drawing Figures

FIG. 10
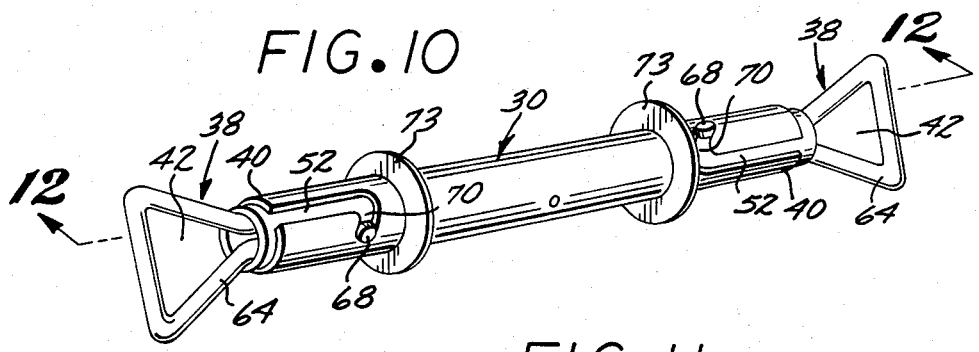
FIG. 11
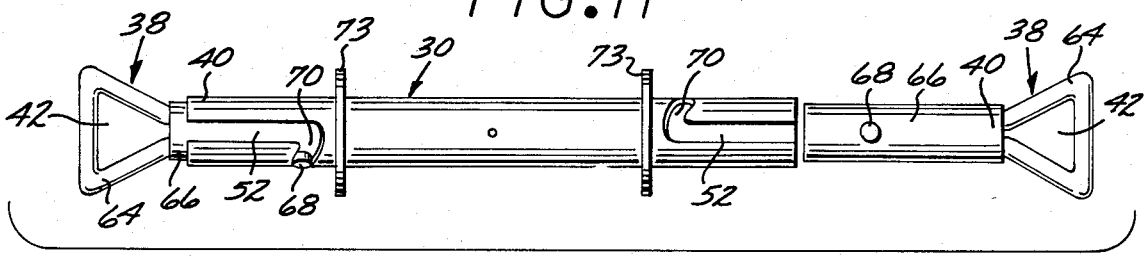
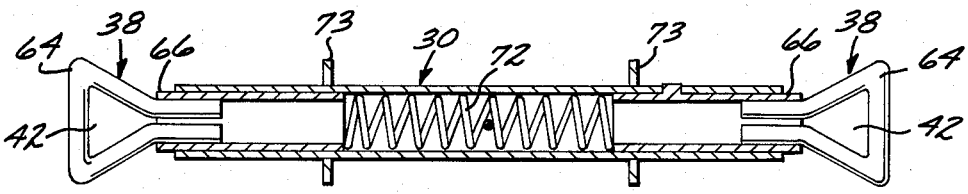
FIG. 12
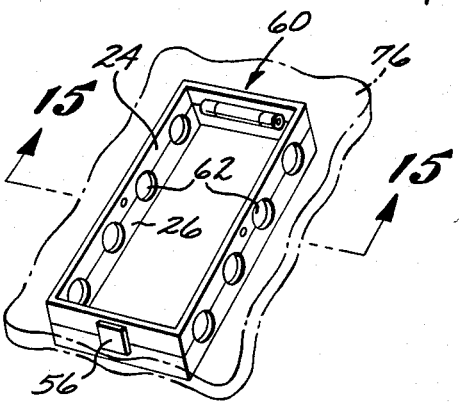
FIG. 13
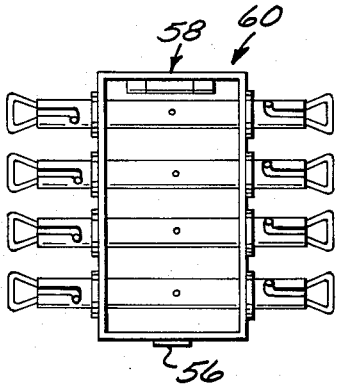
FIG. 14
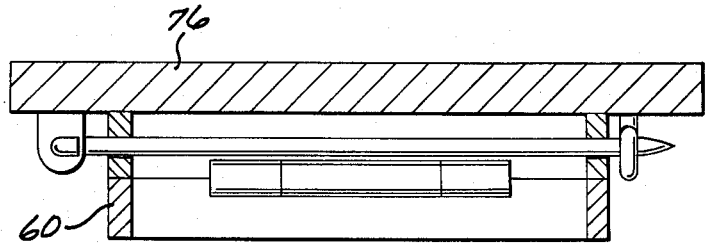
FIG. 15

FASTENING BUCKLE FOR CHAINS, STRINGS OF BEADS, PEARLS AND LIKE JEWELRY

BACKGROUND OF THE INVENTION

1. Field of the Invention

The present invention is directed to a fastening device for chains, strings of beads, pearls and like jewelry. More particularly, the present invention is directed to a clasp or buckle type fastening device whereby several chains, strings of beads, pearls and the like may be fastened and arranged into various multi-stranded ornamental configurations.

2. Brief Description of the Prior Art

Several clasp or buckle type devices have been known in the prior art, which are adapted for fastening or joining one or several strands or strings of beads, pearls, chains or the like to form multi-stranded ornamental configurations. Examples of such prior art clasp or buckle type devices used in conjunction with jewelry, and particularly chains and strings of beads and pearls, are found in U.S. Pat. Nos. 3,323,324, 1,746,054, 3,135,031, 2,644,992, 2,586,758.

Generally speaking, prior art clasps or buckles for chains and strings of beads, and the like, accomplish the purpose of joining several chains or strings into a closed loop either by locking ends of the chains in a box shaped member (U.S. Pat. No. 2,586,758), or by attaching several ends of the chains or of the strings to a single clasp or buckle (U.S. Pat. No. 3,323,324). Alternatively, several ends of chains or strings are attached to two separate pieces of a clasp or buckle, and the two pieces are thereafter joined to one another by a locking mechanism (U.S. Pat. Nos. 3,135,031 and 2,644,992).

As it is readily appreciated by those skilled in the jewelry and related arts, a clasp or buckle for joining several chains, or strings of beads, pearls and the like into closed loops should satisfy the following requirements. The clasp or buckle must be ornamental in appearance so as to supplement the decorative effect of the jewelry with which it is used. The clasp or buckle must be safe in the sense that accidental opening of the clasp or buckle may result in inadvertent loss of highly valuable precious metal chains or pearls. The clasp or buckle must be relatively easy to use. More particularly, it must be relatively easy for the user to lock after the chains or strings of beads have been mounted to the clasp or buckle. Still more particularly, an ideal clasp or buckle of the type of which the present invention pertains should permit a user to arrange with relative ease the several chains or strings of beads or pearls in various desired ornamental configurations. Considering that a typical user of a clasp or buckle of the above-noted type is a lady of no mechanical training or skills, it is readily understood that the above-noted requirements are relatively hard to meet.

Still further, it should be considered that the clasp or buckle of the type discussed here must relatively readily adapt itself for manufacture at a reasonable cost. Prior art clasps or buckles for chains or strings of beads or pearls have been only moderately successful in meeting the aforementioned requirements, and leave ample room for improvement. The present invention overcomes the deficiencies of the prior art and provides a needed improvement.

SUMMARY OF THE INVENTION

It is an object of the present invention to provide a clasp or buckle type device for chains, strings of beads, pearls and like jewelry which is assembled by a wearer of the jewelry with relative ease.

It is another object of the present invention to provide a clasp or buckle type device for chains, strings of beads, pearls and like jewelry which is ornamental in appearance and yet securely connects ends of the chains or strings to form closed loops.

It is still another object of the present invention to provide a clasp or buckle type device for chains, strings of beads, pearls and like jewelry wherein a wearer of the jewelry may readily arrange the configuration of the several chains or strings.

These and other objects and advantages are attained by a clasp or buckle which has a plurality of connecting members having, substantially at their respective ends, hooks, loops or eyelets for attachment to respective ends of a chain or string. A substantially hollow main buckle member has first and second portions hingedly mounted to one another. The main buckle member receives and removably mounts the connecting members in such a manner that substantially only the loops or hooks of the connecting members protrude from the main buckle member. The connecting members are held by an appropriate spacer in the main buckle member in substantially parallel relationship to one another. A wearer of the chains or strings of beads or pearls may mount one chain or string to each connecting member, and may use only some or all of the connecting members for fastening closed loops, chains or strings to the clasp or buckle.

The features of the present invention can be best understood, together with further objects and advantages, by reference to the following description, taken in connection with the accompanying drawings, wherein like numerals indicate like parts.

BRIEF DESCRIPTION OF THE DRAWINGS

FIG. 10 is a perspective view of a connecting member of a second preferred embodiment of the jewelry clasp or buckle of the present invention;

FIG. 11 is a partially exploded side view of the connecting member shown on FIG. 10;

FIG. 12 is a cross-sectional view of the connecting member shown on FIG. 10, the cross-section being taken on lines 12,12 of FIG. 10;

FIG. 13 is a schematic perspective view of a hollow frame member of the second preferred embodiment;

FIG. 14 is a top view of the second preferred embodiment of the jewelry clasp or buckle of the present invention, the view showing a plurality of connecting members assembled in the frame member, and FIG. 15 is a cross-sectional view of the second preferred embodiment, the view showing a piece of jewelry such as a pin being mounted to the frame member.

DESCRIPTION OF THE PREFERRED EMBODIMENTS

Figure 1:
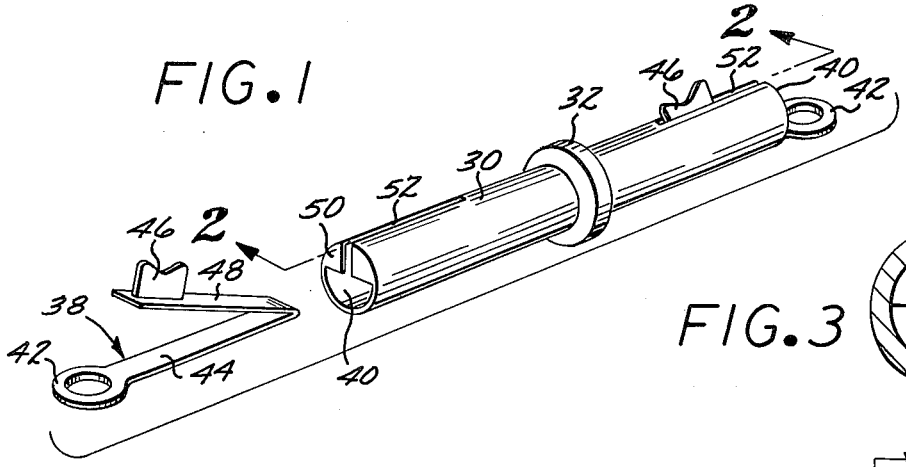
FIG. 1 is a partially exploded perspective view of a connecting member of a first preferred embodiment of the jewelry clasp or buckle of the present invention.
Figure 3:
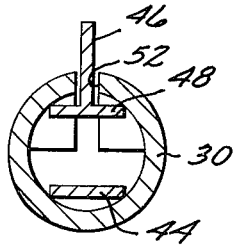
FIG. 3 is a cross-sectional view of the connecting member shown on FIG. 2, the cross-section being taken on lines 3,3 of FIG. 2.

The following specification taken in connection with the drawings sets forth the preferred embodiments of the present invention. The embodiments of the invention disclosed herein are the best modes contemplated by the inventor for carrying out the inventor's invention in a commercial environment, although it should be understood that various modifications can be accomplished within the parameters of the present invention.

Referring now to the drawing Figures, and particularly to FIGS. 1 through 9, a first preferred embodiment 20 of the jewelry clasp or buckle of the present invention, is disclosed.

It should be noted at the outset, that the jewelry clasp or buckle is designed to permit mounting several chains, strings or strands of beads, pearls and the like in closed loops in a decorative manner, principally for the purpose of being worn by a person (not shown). The environment wherein the jewelry clasp or buckle of the present invention is primarily used is best indicated in U.S. Pat. Nos. 2,586,758 and 3,135,031 the specification of which is hereby expressly incorporated by reference. Thus, it follows from the foregoing, that a user of the jewelry clasp or buckle 20 of the present invention may attach both ends of a chain (not shown), string of beads (not shown) or pearls (not shown) to the clasp or buckle 20. The ensuing description discloses the novel and unique structure of the clasp or buckle 20 which permits the above-noted attachment in such a manner that the user (not shown) may optionally vary the number and configuration of the several chains (not shown) or strings of beads or pearls (not shown) so as to create various subjectively selected ornamental effects.

Referring still principally to FIGS. 1 through 9, a substantially box shaped hollow member 22 is shown which incorporates a first and a second portion 24 and 26. The two portions 24 and 26 are connected to one another by a suitable hinged pin 28 or the like. The hingedly connected two portions 24 and 26 jointly comprise the box shaped hollow or main buckle member 22 into which a plurality of connecting members 30 are mounted. The connecting members 30 are best shown on FIGS. 1, 2, 3 and 8.

Thus, each connecting member 30 is a substantially tubular member having a centrally disposed outer circumferential flange 32. The flange 32 permits mounting of the connecting member 30 into a cross-piece 33. The cross-piece 33 together with the connecting member 30 is, in turn, mounted into an appropriately disposed spacer groove 34 which is located in the interior 36 of the hollow or main buckle member 22.

Each tubular connecting member 32 receives two end pieces 38 with one end piece 38 being mountable to each end 40 of the connecting member 30. In the herein described first preferred embodiment 20, each end piece 38 is an elongated substantially flat member having a loop or eyelet 42 at one end 40. A flat main body 44 of the end piece 38 is folded back upon itself, as shown on FIGS. 1 and 2, to form a leaf spring. A protruding thumb piece 46 is attached to the folded-back portion 48 of the end piece 38.

Figure 2:
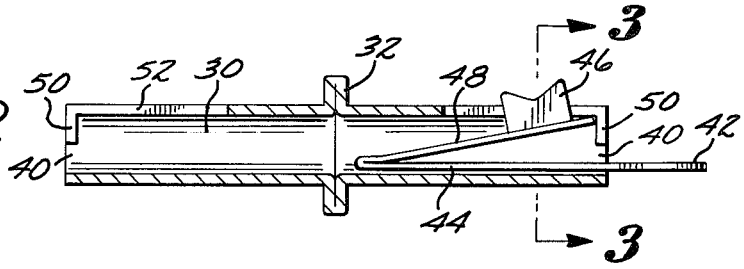
FIG. 2 is a cross-sectional view of the connecting member shown on FIG. 1, the cross-section being taken on lines 2,2 of FIG. 1.
Figure 4:
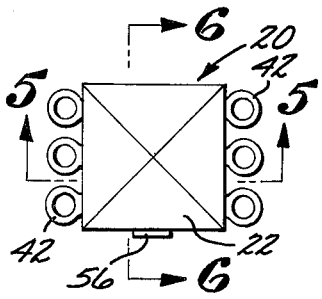
FIG. 4 is a schematic top view of the first preferred embodiment of the jewelry clasp or buckle of the present invention.
Figure 5:
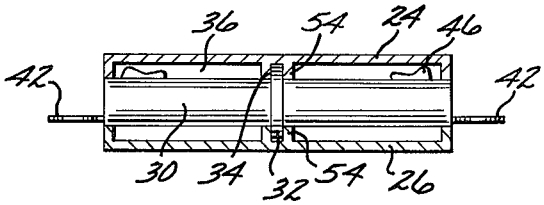
FIG. 5 is a cross-sectional view of the first preferred embodiment shown on FIG. 4, the cross-section being taken on lines 5,5 on FIG. 4.
Figure 6:
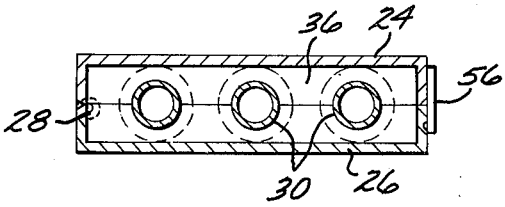
FIG. 6 is another cross-sectional view of the first preferred embodiment shown on FIG. 4, the cross-section being taken on lines 6,6 of FIG. 4.
Figure 7:
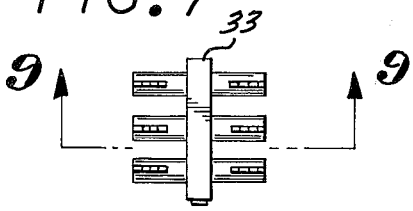
FIG. 7 is a schematic top view of the first preferred embodiment of the jewelry clasp or buckle of the present invention, the view showing a plurality of connecting members assembled in a cross-piece.
Figure 8:
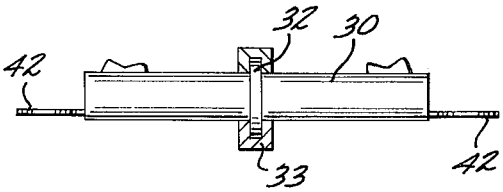
FIG. 8 is a side view of a connecting member of the first preferred embodiment assembled to the cross-piece.
Figure 9:
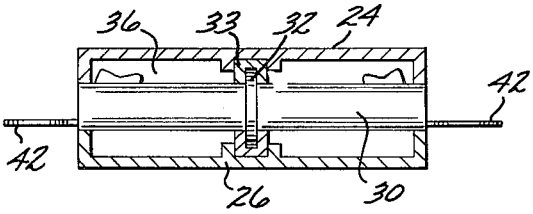
FIG. 9 is a cross-sectional view of the first preferred embodiment, the cross-section being taken on lines 9,9 of FIG. 7.

In order to retain the end pieces 38, each end 40 of the connecting member 30 includes an ear 50 which partially closes the tubular interior of the connecting member 30. Each end 40 of the connecting member 30 also has a longitudinal slot 52. In order to insert the end piece 38 into the connecting member 30, a user (not shown) slides the end pieces 38 into the interior of the connecting member 30 until the folded back portion 48 engages the ear 50, as is shown in FIG. 2. The thumb piece 46 simply protrudes slightly from the connecting member 30 through the slot 52. This permits a user (not shown) to depress the thumb piece 46 for disengagement of the folded back portion 48 from the ear 50 and removal of the end piece 38 from the connecting member 30. The loops or eyelets 42 of the end pieces 38 permit attachment of one end of a chain (not shown), string of beads (not shown) pearls or the like to each end piece 38, as is more specifically shown in the above-noted patents incorporated herein by reference.

Referring now more particularly to FIGS. 4 through 7, the box shaped hollow or main buckle member 22 is shown to incorporate several of the connecting members. In order to permit mounting of the several connecting members 30 into the main buckle 30 in a substantially parallel, substantially evenly spaced relationship, the main buckle member 22 has interior protrusions 54, shown on FIG. 5, which form the groove 34 to receive the unitary cross piece 33. As noted above, the cross-piece 33 mounts the connecting members 30 through the flanges 32.

The main buckle member 22 also has circumferential notches wherethrough the flat end pieces 38 protrude as is shown on FIGS. 4, 5, 8 and 9. The connecting members 30, when assembled in the main buckle member 22, are disposed substantially at a right angle to the hinge pin 28. Therefore, the connecting members 30 may be placed into the main buckle member 22 while the main buckle member 22 is open. A locking device 56 is disposed on the exterior of the main buckle member 22 to lock the first and second portions 24 and 26 to one another, and thereby also lock the connecting members 30 securely in place. The locking device 56 may be constructed in accordance with present state of the jewelry arts, and is therefore not disclosed herein in detail.

It should already follow from the foregoing description and an inspection of FIGS. 1 through 9, that a user (not shown) of the jewelry clasp or buckle 20 of the present invention has many options regarding the use of the buckle 20. More specifically, the user (not shown) may attach a chain (not shown) or string of beads, pearls (not shown) and the like to the end pieces 38 of the connecting member 30 either while the end pieces 38 are disposed in the respective connecting members 30, or are removed therefrom. The connecting members 30 having the end pieces 38 assembled therein, and the chains (not shown) or strings of beads, pearls and the like (not shown) attached thereto, may then be mounted into the main buckle member 22. Thereafter, the main buckle member 22 is locked.

A user (not shown) may, at his or her option, utilize all or only some of the connecting members depending on how many chains (not shown) or strings (not shown) the user (not shown) wishes to employ in the ornamental jewelry configuration (not shown) wherein the clasp or buckle 20 of the invention is utilized. In order to enhance the decorative effect of the clasp or buckle 20, a user (not shown) may wish to remove those connecting members 30 from the buckle 22, which do not have chains (not shown) or strings (not shown) attached.

As still another alternative, a user (not shown) may simply mount the desired number of connecting members 30 into the cross-piece 33 and thereafter into the hollow main buckle member 22, lock the buckle 20, and therafter attach the chains (not shown) or strings of beads, pearls and the like (not shown) to the protruding eyelets 42 of the connecting members 30.

It is noted in connection with the appended drawing Figures, that said Figures depict that jewelry clasp or buckle 20 of the present invention somewhat enlarged in size. Although size of the clasp or buckle 20 is not a critical aspect of the present invention, it will be readily apparent to those skilled in the art that for applications in conjunction with fine jewelry, the clasp or buckle of the present invention is preferably manufactured quite small, sometimes even smaller than the actual size of FIG. 4. Furthermore, as is customary in the jewelry manufacturing arts, several components of the clasp or buckle 20 may be made of precious metals, or may be made of material coated or plated with precious metals.

Referring now to FIGS. 10 through 14, a second preferred embodiment 58 of the jewelry clasp or buckle of the present invention is disclosed. In many respects, the second preferred embodiment 58 is similar in structure and application to the first preferred embodiment. However, as is best shown on FIG. 13, the first and second portions 24 and 26 of the main buckle member 22 of the second preferred embodiment 58 form an open frame 60, and do not enclose space in the same manner as the main buckle member of the first preferred embodiment 20. Furthermore, the hingedly connected first and second portions 24 and 26 of the second preferred embodiment 58 jointly form a plurality of substantially regularly spaced, substantially circular openings 62 which receive, mount, and align a plurality of connecting members 30.

The connecting members 30 of the second preferred embodiment 58 also include end pieces 38 which are mounted to respective ends 40 of the connecting members 30. In this embodiment, each end piece 38 includes a bent rod or wire 64 which forms a loop or eyelet 42 to receive ends of a chain (not shown) or string of beads, pearls (not shown) or the like. The end piece 38 also includes a substantially straight shaft 66 and a protruding stub 68. The stub 68 is accommodated in a longitudinal slot 52 disposed in the tubular connecting member 30. Each longitudinal slot 52 includes a portion of branch 70 disposed at an angle to the main slot 52, as is shown on FIGS. 10 and 11. When the end piece 38 is assembled into the connecting member 30, the stub 68 rests in the angular branch 70 of the slot 52. A coil spring 72 mounted in the interior of the connecting member 30 biases against both end pieces 38 to form a "bayonette" lock, and holds the end pieces 38 in position in the connecting member 30.

Each connecting member 30 of the second preferred embodiment 58 includes a pair of circumferential flanges 73 which engage the frame 60 as shown on FIG. 14, and prevent lateral sliding of the connecting member 30 in the frame 60.

Further description of the structure and utilization of the second preferred embodiment 58 of the jewelry clasp or buckle of the present invention for mounting a plurality of chains (not shown) or strings or beads, pearls and the like (not shown) is not deemed to be necessary here in light of the apparent similarities between the first and second preferred embodiments.

Referring now to FIGS. 13 and 14, use of the clasp or buckle of the second preferred embodiment for mounting a singular piece of jewelry such as a pin 76 (other than a chain or string of beads or pearls) is shown. For this purpose, the connecting members 30 are omitted from the assembled structure, and the pin 76 is simply inserted and locked into one pair of aligned openings 62 in the frame 60. The two portions 24 and 26 of the frame are locked to one another by a state-of-the-art locking device 56.

What has been described above is a novel and versatile jewelry clasp or buckle which is highly adapted for permitting the assembly of several chains, strings of beads, pearls and the like in closed loops in ornamental multi-stranded configurations. Since several modifications of the present invention may become apparent to those skilled in the art in light of the above disclosure, the scope of the present invention should be interpreted solely from the following claims.

What is claimed is:

1. A buckle adapted for joining a plurality of strings of beads, pearls and the like in closed loops for decorative jewelry purposes, the buckle comprising:

a plurality of connecting members, each connecting member having two ends and means disposed substantially at each respective end for attaching one end of a string of beads to the respective end of the connecting member, each of said members being formed with external flange means, and a substantially hollow member having an upper and a lower portion and means for hingedly connecting said upper and lower portions to one another, the hollow member including spacer means therein adapted to engage the external flanges of said connecting members for retaining the plurality of connecting members in the hollow member in substantially parallel spaced relationship to one another.

2. The buckle of claim 1 wherein the hollow member is a substantially box shaped member.

3. The buckle of claim 1 wherein each connecting member comprises a substantially tubular member.

4. The buckle of claim 3 wherein each of the means for attaching comprise a keeper member insertable into one end of a respective tubular member and retainable therein.

5. The buckle of claim 4 wherein each keeper member includes eyelet means adapted for attaching one end of a string of beads, pearls and the like.

6. The buckle of claim 5 wherein each tubular member includes at least one slot at each end thereof, and wherein each keeper member includes spring means insertable into one of the respective slots, the spring means being adapted for removably locking the keeper member into the tubular member.

7. The buckle of claim 5 wherein each tubular member incorporates a spring, a slot adjacent to each end of the tubular member, and wherein each keeper member includes means for removably engaging the slot under bias of the spring and for retaining the keeper member in the tubular member.

8. A clasp assembly for mounting a plurality of strings of beads, pearls, pins and the like for the purpose of decorative jewelry, the assembly comprising:

a plurality of tubular members each having two ends and at least one external flange;

a plurality of end pieces for said tubular members, each end piece being removably mountable substantially to one end of a tubular member and having eyelet means for permitting mounting a chain, string of beads, pearls and the like to the end piece, and a substantially hollow member having a first and a second portion connected to one another, said hollow member being capable of substantially incorporating the assembled plurality of tubular members and being adapted to engage the flanges of said tubular members to retain the latter in parallel relation with the end pieces having at least the eyelet means of the end pieces protruding from said hollow member.

9. The clasp assembly of claim 8 wherein the hollow member includes spacer and retainer means for holding the tubular members in substantially regularly spaced and substantially parallel relationship relative to one another.

10. The clasp assembly of claim 8 wherein the first and second portions of the hollow member jointly comprise hinge means for hingedly connecting the first and second portions to one another.

11. The clasp assembly of claim 10 wherein the first and second portions of the hollow member jointly comprise lock means for locking the first and second portions to one another and thereby lock the assembled plurality of the tubular members and the end pieces in the hollow member.

12. The clasp assembly of claim 8 wherein each tubular member is substantially hollow, and wherein each end piece is adapted for being inserted into the hollow tubular member.

13. The clasp assembly of claim 12 wherein each end piece includes leaf spring means for removably locking the end piece into the respective end of the tubular member.

14. The clasp assembly of claim 12 wherein each tubular member includes spring means for removably locking end pieces into the respective ends of the tubular member.

15. The clasp assembly of claim 8 wherein the first and second portions of the hollow member jointly comprise substantially circular openings for spacing and retaining the tubular members in substantially parallel, substantially regularly spaced relationship relative to one another.

* * * * *